US009141029B2

(12) United States Patent
Kim et al.

(10) Patent No.: US 9,141,029 B2
(45) Date of Patent: Sep. 22, 2015

(54) DEVELOPING DEVICE AND ELECTROPHOTOGRAPHIC IMAGE FORMING APPARATUS HAVING THE SAME

(71) Applicant: Samsung Electronics Co., Ltd., Suwon-si (KR)

(72) Inventors: Jong-in Kim, Suwon-si (KR); Dong-uk Kim, Suwon-si (KR); Ki-hyun Yoo, Suwon-si (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 14/286,200

(22) Filed: May 23, 2014

(65) Prior Publication Data

US 2015/0139690 A1 May 21, 2015

(30) Foreign Application Priority Data

Nov. 19, 2013 (KR) ..... 10-2013-0140896

(51) Int. Cl.
*G03G 15/08* (2006.01)
*G03G 21/10* (2006.01)
*G03G 21/12* (2006.01)

(52) U.S. Cl.
CPC ..... *G03G 15/0865* (2013.01); *G03G 21/10* (2013.01); *G03G 21/12* (2013.01); *G03G 2221/1624* (2013.01)

(58) Field of Classification Search
CPC G03G 21/10; G03G 21/12; G03G 2221/1624
USPC ..... 399/358–360
See application file for complete search history.

(56) References Cited

U.S. PATENT DOCUMENTS

| | | | | |
|---|---|---|---|---|
| 4,054,381 | A | 10/1977 | Bernhard | |
| 5,710,690 | A | 1/1998 | Bontempo et al. | |
| 5,950,062 | A | 9/1999 | Yahata et al. | |
| 6,151,471 | A * | 11/2000 | Yahata et al. | 399/258 |
| 6,961,530 | B2 | 11/2005 | Arai et al. | |
| 7,302,212 | B2 | 11/2007 | Leute | |
| 7,369,796 | B2 * | 5/2008 | Amano et al. | 399/254 |
| 2001/0022905 | A1 * | 9/2001 | Kosuge et al. | 399/159 |
| 2002/0067932 | A1 * | 6/2002 | Arai et al. | 399/253 |
| 2011/0182615 | A1 * | 7/2011 | Morishita | 399/111 |
| 2012/0207517 | A1 * | 8/2012 | Tsuru et al. | 399/258 |

FOREIGN PATENT DOCUMENTS

| | | |
|---|---|---|
| JP | 10-293461 | 11/1998 |
| JP | 2000-039823 | 2/2000 |
| JP | 2001-051570 | 2/2001 |
| JP | 2001-175135 | 6/2001 |
| JP | 2003-287958 | 10/2003 |
| JP | 2003-287990 | 10/2003 |
| JP | 2006-018006 | 1/2006 |

* cited by examiner

*Primary Examiner* — Rodney Bonnette
(74) *Attorney, Agent, or Firm* — Staas & Halsey LLP

(57) ABSTRACT

An electrophotographic image forming apparatus is provided. The electrophotographic image forming apparatus includes a main body having an opening; a developing cartridge, detachably installed in the main body through the opening in a first direction, which includes a photosensitive drum and a cleaning member for removing a toner remaining in the photosensitive drum; and a toner recycle unit, detachably installed in the developing cartridge through the opening in the first direction, which recovers the toner removed by the cleaning member, filters the recovered toner, and supplies the toner again to the developing cartridge.

18 Claims, 15 Drawing Sheets

DEVELOPING DEVICE AND ELECTROPHOTOGRAPHIC IMAGE FORMING APPARATUS HAVING THE SAME

CROSS-REFERENCE TO RELATED APPLICATIONS

This application claims the priority benefit of Korean Patent Application No. 10-2013-0140896, filed on Nov. 19, 2013, in the Korean Intellectual Property Office, the disclosure of which is incorporated herein in its entirety by reference.

BACKGROUND

1. Field

One or more embodiments relate to a developing device that collects a toner remaining in a photoconductor after transferring and reuses the collected toner, and an electrophotographic image forming apparatus including the developing device.

2. Description of the Related Art

Electrophotographic image forming apparatuses supply a toner to a latent electrostatic image formed in a photoconductor to forms a visible toner image on the photoconductor, transfers the toner image to a recording medium, and then fixes the transferred toner image to the recording medium to thereby print an image in the recording medium.

Such image forming apparatuses may be provided with a cleaning member for removing the toner remaining on the photoconductor after transferring, and a waste toner storage unit for storing the toner removed by the cleaning member. In order to reuse the toner stored in the waste toner storage unit, a filter for filtering a toner may be provided.

SUMMARY

In an aspect of one or more embodiments, there is provided a developing device which is capable of easily attaching and detaching a toner recycle unit, filtering a toner recovered from a developing cartridge, and resupplying the tonner, from the developing cartridge, and an electrophotographic image forming apparatus which includes the developing device.

In an aspect of one or more embodiments, there is provided a developing device which is capable of driving a toner recycle unit without using an additional driving unit, and an electrophotographic image forming apparatus which includes the developing device.

In an aspect of one or more embodiments, there is provided an electrophotographic image forming apparatus which includes a main body having an opening; a developing cartridge, detachably installed in the main body through the opening in a first direction, which comprises a photosensitive drum and a cleaning member for removing a toner remaining in the photosensitive drum; and a toner recycle unit, detachably installed in the developing cartridge through the opening in the first direction, which recovers the toner removed by the cleaning member, filters the recovered toner, and supplies the filtered recovered toner again to the developing cartridge.

The toner recycle unit may include a filter member that filters the recovered toner.

The developing cartridge may further include a transport chamber in which a transport member transferring the toner removed by the cleaning member in the first direction is installed. A first toner discharging unit discharging the toner transferred by the transport member to the toner recycle unit may be formed in an end of the transport chamber in the first direction.

The electrophotographic image forming apparatus may further include a toner cartridge, detachably installed in the main body through the opening in the first direction, which supplies a toner accommodated therein to the toner recycle unit.

The toner cartridge may further include a transport chamber in which a transport member transferring a toner accommodated therein in the first direction is installed. A second toner discharging unit discharging the toner transferred by the transport member to the toner recycle unit may be formed in an end of the transport chamber in the first direction.

The developing cartridge may include a developing chamber in which a developing roller disposed to face the photosensitive drum is installed; a first stirring chamber in which a first stirring member disposed to face the developing roller and stirring and transferring a toner is installed; and a second stirring chamber in which a second stirring member stirring and transferring a toner so as to supply the toner to the first stirring member is installed.

A toner injection unit having a toner injected thereinto may be formed in an end of the second stirring chamber in the first direction.

The toner injection unit may be provided with a first inlet into which a toner filtered by the filter member is injected, and a second inlet into which a toner supplied from the toner cartridge is injected. The first inlet may be disposed on the upper steam side than the second inlet in a toner transfer direction by the second stirring member.

The toner recycle unit may further include a stirring member that stirs and transfers a toner filtered by the filter member.

The toner recycle unit may further include a filter cleaning member which is rotatable in a contact state with an inner surface of the filter member.

The filter member may be rotatable. The filter member and the filter cleaning member may have different rotational speeds.

The filter member and the filter cleaning member may be connected to each other by at least one reduction gear.

The toner recycle unit may receive a driving force from the developing cartridge.

The stirring member of the toner recycle unit may receive a driving force from the first stirring member of the developing cartridge.

At least one of the filter member and the filter cleaning member may be associated with (coupled to) the stirring member.

The first direction may be parallel to a longitudinal direction of the photosensitive drum.

According to an aspect of one or more embodiments, there is provided a developing device which includes a developing cartridge comprising a photosensitive drum, and a cleaning member that removes a residual toner which is not transferred to the photosensitive drum; and a toner recycle unit, detachably installed in the developing cartridge in parallel with a longitudinal direction of the photosensitive drum, which recovers the toner removed by the cleaning member, filters the recovered toner, and supplies the filtered recovered toner to the developing cartridge.

The toner recycle unit may receive a driving force from the developing cartridge.

BRIEF DESCRIPTION OF THE DRAWINGS

These and/or other aspects will become apparent and more readily appreciated from the following description of embodiments, taken in conjunction with the accompanying drawings in which.

DETAILED DESCRIPTION

Figure 1:
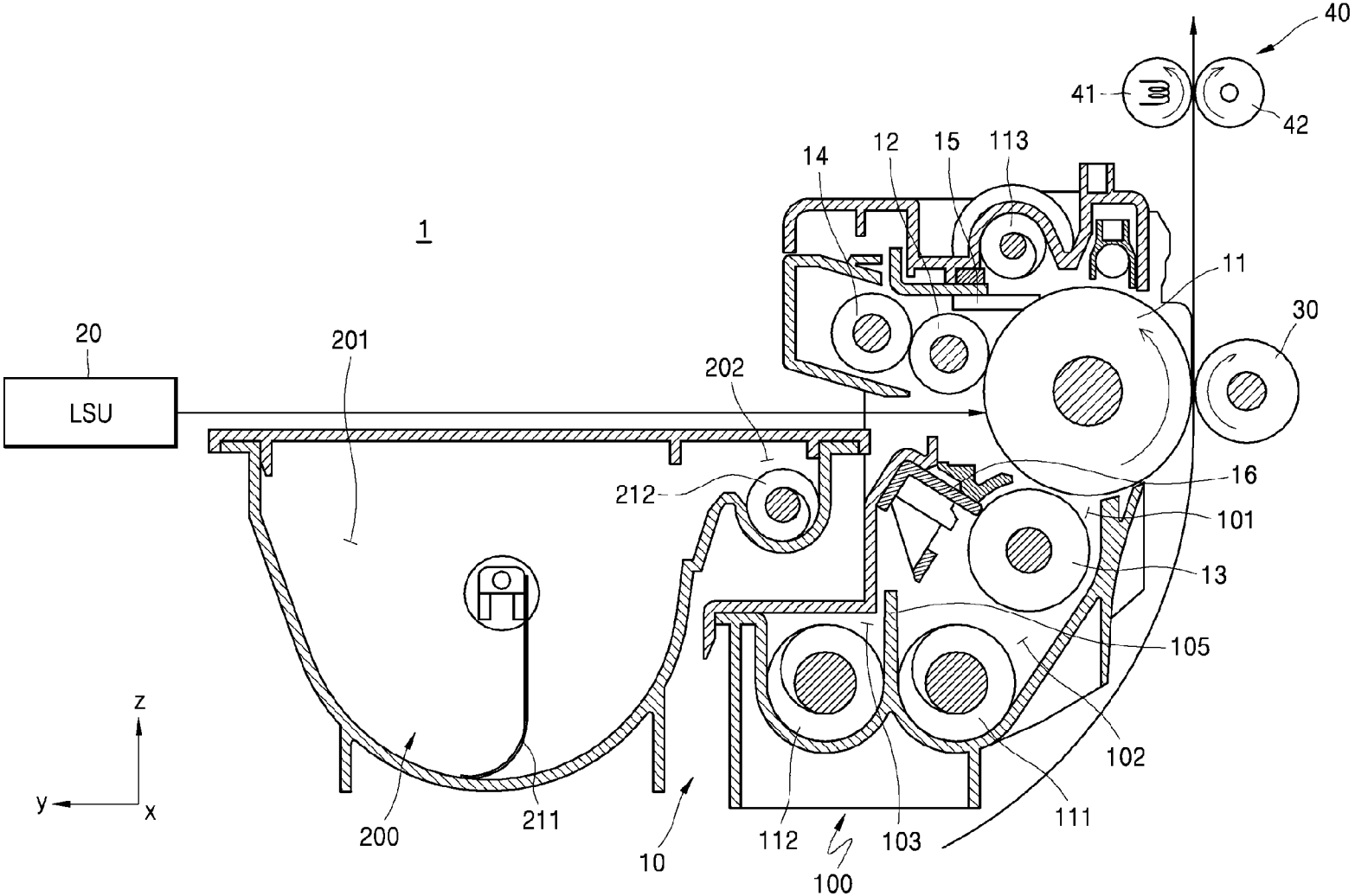
FIG. 1 is a schematic configuration diagram of an electrophotographic image forming apparatus according to an embodiment.

Reference will now be made in detail to embodiments, examples of which are illustrated in the accompanying drawings, wherein like reference numerals refer to like elements throughout. In this regard, embodiments may have different forms and should not be construed as being limited to the descriptions set forth herein. Accordingly, embodiments are merely described below, by referring to the figures, to explain aspects of the present disclosure. Expressions such as "at least one of," when preceding a list of elements, modify the entire list of elements and do not modify the individual elements of the list.

Figure 2:
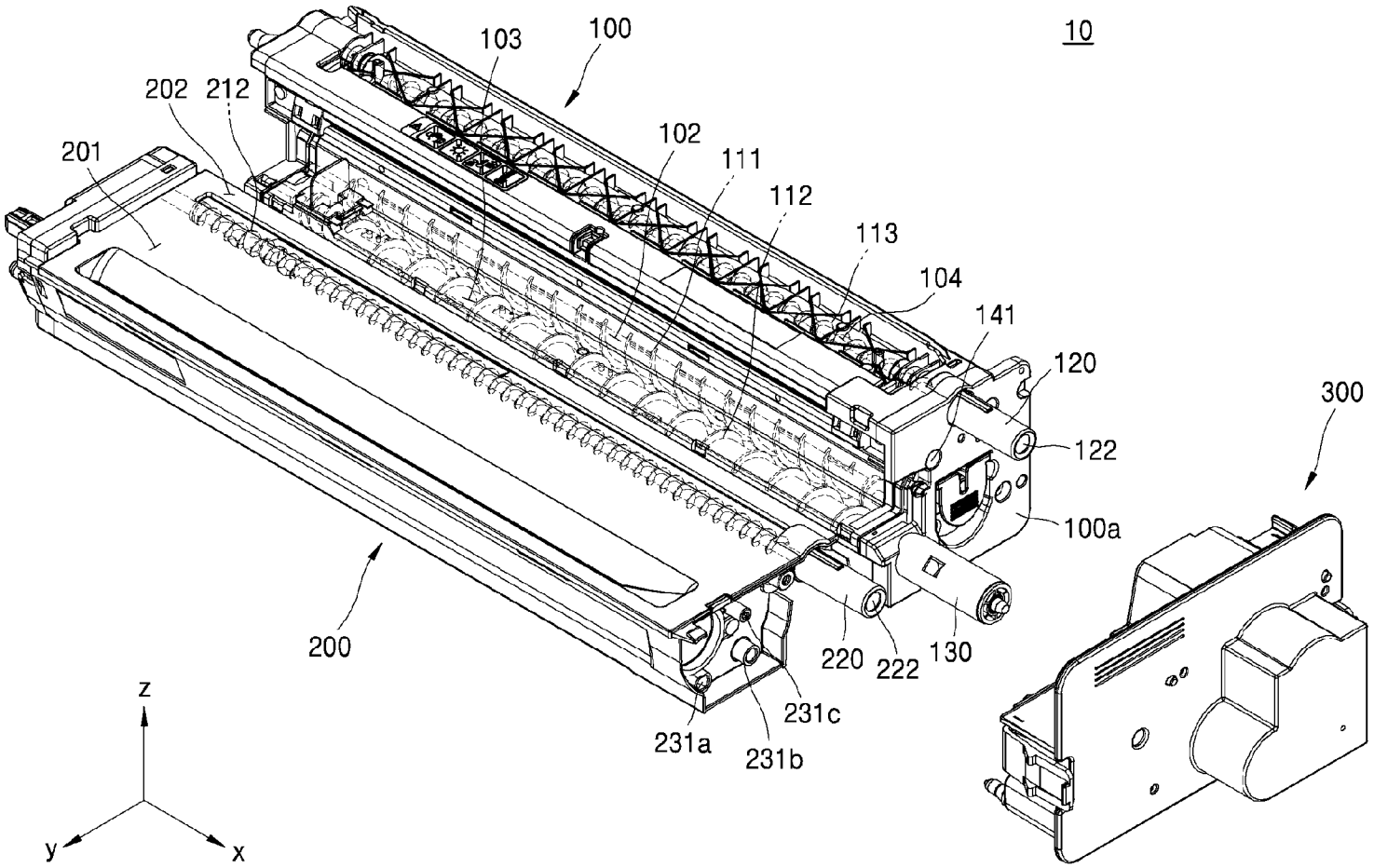
FIG. 2 is a perspective view of the electrophotographic image forming apparatus of FIG. 1.

FIG. 1 is a schematic configuration diagram of an electrophotographic image forming apparatus 1 according to an embodiment. FIG. 2 is a perspective view of the electrophotographic image forming apparatus of FIG. 1. The electrophotographic image forming apparatus 1 according to the current embodiment is a monochrome image forming apparatus using a two-component developer including a toner and magnetic carriers. The color of the toner is, for example, black.

Referring to FIG. 1, the electrophotographic image forming apparatus 1 according to the current embodiment includes a developing device 10, an exposure 20, a transfer roller 30, and a fixing unit (fixer) 40. The developing device 10 includes a developing cartridge 100, a toner cartridge 200, and a toner recycle unit (toner recycler) 300 (see FIG. 2). The developing cartridge 100 includes a photosensitive drum 11, a charge roller 12, and a developing roller 13.

The photosensitive drum 11 is an example of an image carrier in which a latent electrostatic image is formed, and is provided with a photosensitive layer having photoconductivity on the outer circumference of a cylindrical metal pipe.

The charge roller 12 is an example of a charger that charges the photosensitive drum 11 so as to have a uniform surface potential. A charge brush, a corona charger, or the like may be adopted instead of the charge roller 12. The cleaning roller 14 may remove foreign substances attached to a surface of the charge roller 12.

The exposure 20 irradiates the photosensitive drum 11 with light modulated in response to image information, to form a latent electrostatic image in the photosensitive drum 11. Examples of the exposure 20 may include a laser scanning unit (LSU) using a laser diode as a power source, an LED exposure using a light emitting diode (LED) as a power source, and the like.

The developing roller 13 is disposed in a developing chamber 101, and supplies a toner to the latent electrostatic image formed in the photosensitive drum 11 in the developer to form a visible toner image on a surface of the photosensitive drum 11. Reference numeral 16 denotes a regulation member for regulating the amount of toner attached to a surface of the developing roller 13.

When a two-component developing method is adopted as a developing method, the developing roller 13 is located to be separated from the photosensitive drum 11 at a distance of several tens to several hundreds of μm. The developing roller 13, though not shown in the drawing, may be configured in such a manner that a magnetic roller is disposed within a hollow cylindrical sleeve. The toner is attached to a surface of a magnetic carrier. The magnetic carrier is attached to the surface of the developing roller 13 and is carried to a developing region where the photosensitive drum 11 and the developing roller 13 face each other. Only the toner is supplied to the photosensitive drum 11 by a developing bias voltage applied between the developing roller 13 and the photosensitive drum 11 to develop the latent electrostatic image formed in the surface of the photosensitive drum 11 into a visible toner image.

The transfer roller 30 is an example of a transfer unit that transfers a toner image from the photosensitive drum 11 to a recording medium. A transfer bias voltage for transferring the toner image to the recording medium is applied to the transfer roller 30. A corona transfer unit or a pin scorotron type transfer unit may be adopted instead of the transfer roller 30.

The fixing unit 40 attaches the toner image transferred to the recording medium to the recording medium to thereby fix the toner image. The fixing unit 40 is constituted by a heating roller 41 and a pressing roller 42. The heating roller 41 is a cylindrical member rotatable in a direction of a rotation axis, and is provided with a heating source, such as a halogen lamp, therein. The pressing roller 42 is a cylindrical member rotatable in a direction of a rotation axis, and is provided so as to press the heating roller 41. A heat-resistant elastic layer such as silicon rubber may be provided on the outer circumferential surfaces of the heating roller 41 and the pressing roller 42. The recording medium passes through a fixing nip which is a contact region 240 between the heating roller 41 and the pressing roller 42 to fix the toner image in the recording medium.

Operations of the electrophotographic image forming apparatus 1 configured in the above-described manner will be described below.

When the electrophotographic image forming apparatus 1 operates, an image signal of an image to be recorded is transmitted to a controller (not shown). Subsequently, the controller uniformly charges the surface of the photosensitive drum 11 to a predetermined potential by the charge roller 12 on the basis of the received image signal, and then irradiates the surface of the photosensitive drum 11 with a laser beam to form a latent electrostatic image.

In the developing cartridge 100, the toner and the carrier are mixed, stirred, and then sufficiently charged, and then the developer is attached to the developing roller 13. In the developer attached to the developing roller 13, the toner moves to the latent electrostatic image formed on the outer circumferential surface of the photosensitive drum 11 to develop the latent electrostatic image. The toner image formed in this manner is transferred to the recording medium from the photosensitive drum 11 in the transfer nip in which the photosensitive drum 11 and the transfer roller 30 face each other.

The recording medium to which the toner image is transferred is carried to the fixing unit 40. The recording medium passes through between the heating roller 41 and the pressing roller 42 while applying heat and pressure, and thus the toner image is fixed to the recording medium.

The developing cartridge 100 includes a plurality of stirring members 111 and 112 in addition to the photosensitive drum 11, the charge roller 12, and the developing roller 13 which are described above. For example, the developing cartridge 100 may include the first and second stirring members 111 and 112. The first and second stirring members 111 and 112 stir the magnetic carriers constituting the developer with a non-magnetic or feebly-magnetic toner to charge the carriers and the tonner. The first stirring member 111 is disposed in the first stirring chamber 102, and the stirring member 112 is disposed in the second stirring chamber 103.

The first stirring member 111 is disposed so as to face the developing roller 13 in a substantially vertical direction, and supplies the mixed and stirred developer to the developing roller 13. The second stirring member 112 mixes and stirs the developer to sufficiently charge the developer, and transports the charged developer to the first stirring member 111. For example, the first and second stirring members 111 and 112 may be an auger that includes a rotation axis extending in the longitudinal direction (x direction) of the developing roller 13 and a spiral blade formed in the outer circumference of the rotation axis.

The first stirring member 111 and the second stirring member 112 are disposed so as to be parallel to each other. A partition wall 105 is installed between the first stirring member 111 and the second stirring member 112. The first stirring chamber 102 having the first stirring member being disposed therein and the second stirring chamber 103 having the second stirring member 112 disposed therein may be partitioned by the partition wall 105, and the toner may be circulated through an opening (not shown) formed in the partition wall 105.

The first stirring chamber 102 and the second stirring chamber 103 are formed to extend in the longitudinal direction of the developing roller 13. Referring to FIG. 2, a toner injection unit (injector) 130 having an end injected with a toner is formed in the longitudinal direction (x direction) of the second stirring chamber 103. The toner injection unit 130 may protrude in the longitudinal direction of the second stirring chamber 103 rather than the first stirring chamber 102. The longitudinal direction of the developing roller 13 may be parallel to the longitudinal direction (x direction) of the photosensitive drum 11.

The toner cartridge 200 supplies a fresh toner to the developing cartridge 100. The toner cartridge 200 includes a transport chamber 202 and a stirring chamber 201 in order to stir and transport the fresh toner accommodated therein. A transport member 212 is disposed in the transport chamber 202, and a stirring member 211 is disposed in the stirring chamber 201. The transport member 212 transports the fresh toner within the transport chamber 202, and the stirring member 211 stirs the fresh toner within the stirring chamber 201 and transports the fresh toner to the transport chamber 202. The transport member 212 may be an auger that includes a rotation axis extending in the longitudinal direction of the photosensitive drum 11 and a spiral blade formed in the outer circumference of the rotation axis. The stirring member 211 may be provided with a rotation axis extending in the longitudinal direction of the photosensitive drum 11 and one or a plurality of stirring blades, having a flexible film shape, in the rotation axis. The fresh toner accommodated in the toner cartridge 200 is transported to the transport member 212 by the rotation of the stirring member 211, and is transported in the longitudinal direction (x direction) of the photosensitive drum 11, for example, in a direction toward the toner recycle unit 300, by the rotation of the transport member 212.

Referring to FIG. 2, the transport chamber 202 is formed to extend in the longitudinal direction of the transport member 212. The longitudinal direction of the transport member 212 may be parallel to the longitudinal direction of the photosensitive drum 11. In the transport chamber 202, a second toner discharging unit (second toner discharger) 220 discharging the fresh toner is formed at an end of the transport member 212 in the longitudinal direction. The second toner discharging unit 220 may protrude in the longitudinal direction of the transport member 212 rather than the stirring chamber 201. The fresh toner transported by the transport member 212 may be discharged through the second toner discharging unit 220. The toner discharged through the second toner discharging unit 220 is supplied to the toner injection unit 130 of the developing cartridge 100 via the toner recycle unit 300. A second shutter 222 that determining the discharging of the toner may be disposed at an end of the second toner discharging unit 220.

The toner supplied to the toner injection unit 130 is supplied to the photosensitive drum 11 via the second stirring member 112, the first stirring member 111, and the developing roller 13 to form a toner latent image, and is transferred by the transfer roller. After the transfer, the toner remaining in a photoconductor is removed by the cleaning blade 15. The cleaning blade 15 is an example of a cleaning member that removes a toner remaining on the surface of the photosensitive drum 11 after the transfer. Any of other different types of cleaning members, such as a rotating brush, may be adopted instead of the cleaning blade 15.

The developing cartridge 100 includes a transport chamber 104 provided with a transport member 113 that transports the toner removed by the cleaning blade 15 in the longitudinal direction (x direction) of the photosensitive drum 11, for example, in a direction toward the toner recycle unit 300. The transport member 113 may be an auger that includes a rotation axis extending in the longitudinal direction of the photosensitive drum 11 and a spiral blade formed in the outer circumference of the rotation axis. The transport chamber 104 is formed to extend in the longitudinal direction of the transport member 113. A first toner discharging unit 120 discharging the toner removed by the cleaning blade 15 is formed at an end of the transport chamber 104 in the longitudinal direction. The first toner discharging unit (first toner discharger) 120 may protrude in the longitudinal direction of the transport member 113. The toner transported by the transport member 113 may be supplied to the toner recycle unit 300 through the first toner discharging unit 120. Thus, the toner recycle unit 300 may recover the toner removed by the cleaning blade 15. A first shutter 122 determining the discharging of the toner may be disposed at an end of the first toner discharging unit 120.

In order to improve efficiency of a toner use, a recovered toner (hereinafter, referred to as a "recovery toner") may be recycled. However, since the recovery toner has a higher agglomerative property than the fresh toner of the toner cartridge 200, at least some of recovery toners may have a size larger than an appropriate size. When the recovery toner having a size larger than an appropriate size is immediately supplied again to the developing cartridge 100, degradation in image quality, such as the generation of black spots, may occur. In order to prevent the degradation in image quality, a toner having a size larger than an appropriate size (hereinafter, referred to as "waste toner") in the recovery toner is filtered, and then only a toner satisfying an appropriate size (hereinafter, referred to as "recycle toner") is required to be supplied again to the developing cartridge 100. For this, the electrophotographic image forming apparatus 1 according to the current embodiment may include the toner recycle unit 300 that recovers and filters a toner removed from the photosensitive drum 11 of the developing cartridge 100 and supplies the toner again to the developing cartridge 100.

The toner recycle unit 300 according to the current embodiment may be detachably installed in the developing cartridge 100. In addition, the toner recycle unit 300 may be detachably installed in the toner cartridge 200. The toner recycle unit 300, the toner cartridge 200, and the developing cartridge 100 are consumable parts that are periodically required to be replaced, and may have different replacement periods. For example, the developing cartridge 100 may have a longest replacement period, and the toner recycle unit 300 may have a shortest replacement period. In this manner, the toner recycle unit 300 having a relatively short replacement period is detachably installed in the developing cartridge 100 having a relatively long replacement period, and thus a user may easily replace only the toner recycle unit 300 without replacing the developing cartridge 100.

The toner recycle unit 300 may be detachably installed in an end 100*a* of the developing cartridge 100 in a longitudinal direction. The toner recycle unit 300 is installed in the end 100*a* of the developing cartridge 100 in the longitudinal direction, and thus the attachment and detachment of the toner recycle unit 300 to and from the developing cartridge 100 may be easily performed. For this reason, general users may easily replace the toner recycle unit 300, which will be described in detail with reference to FIGS. 3A and 3B.

Figure 3A:
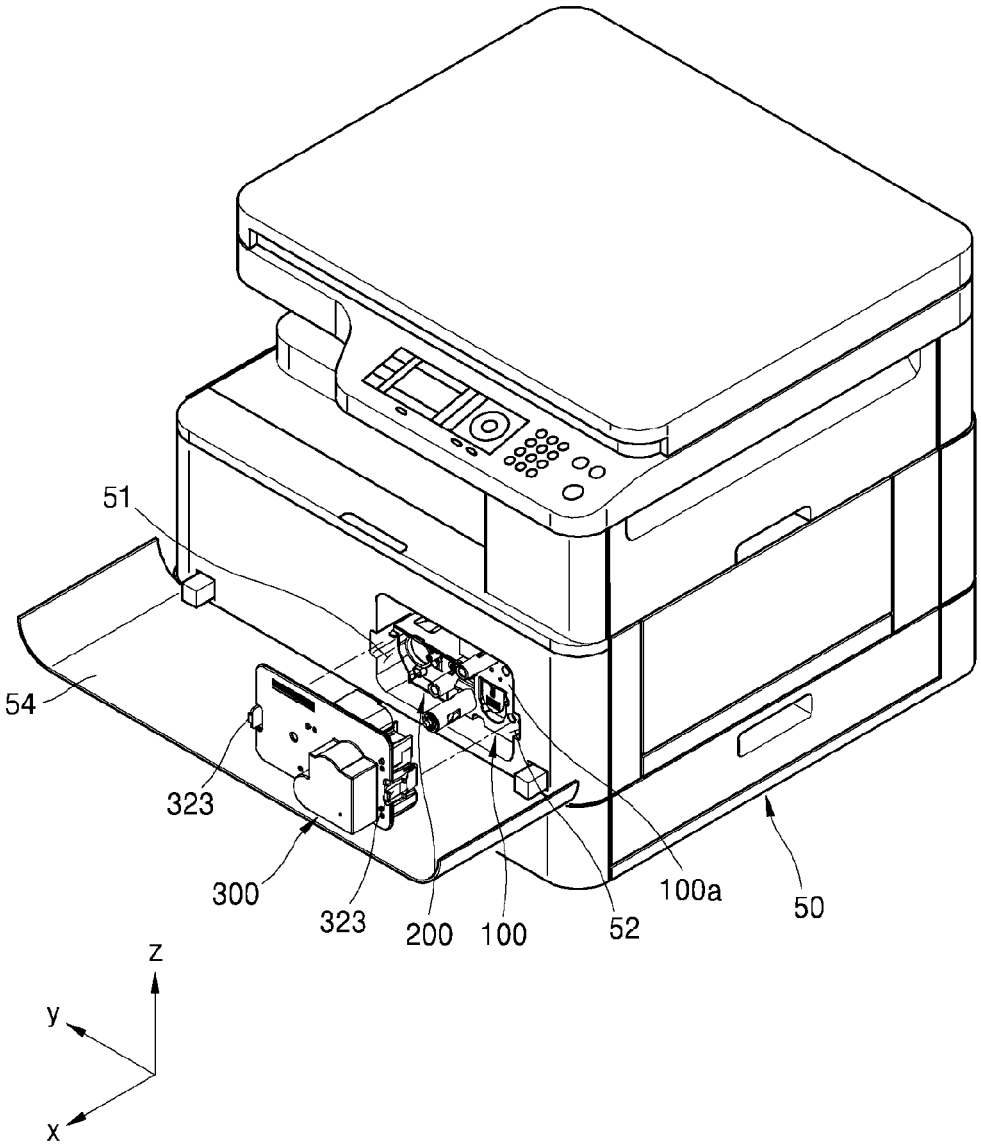
FIG. 3A illustrates an example in which a toner recycle unit is removed from a developing cartridge shown in FIG. 2.
Figure 3B:
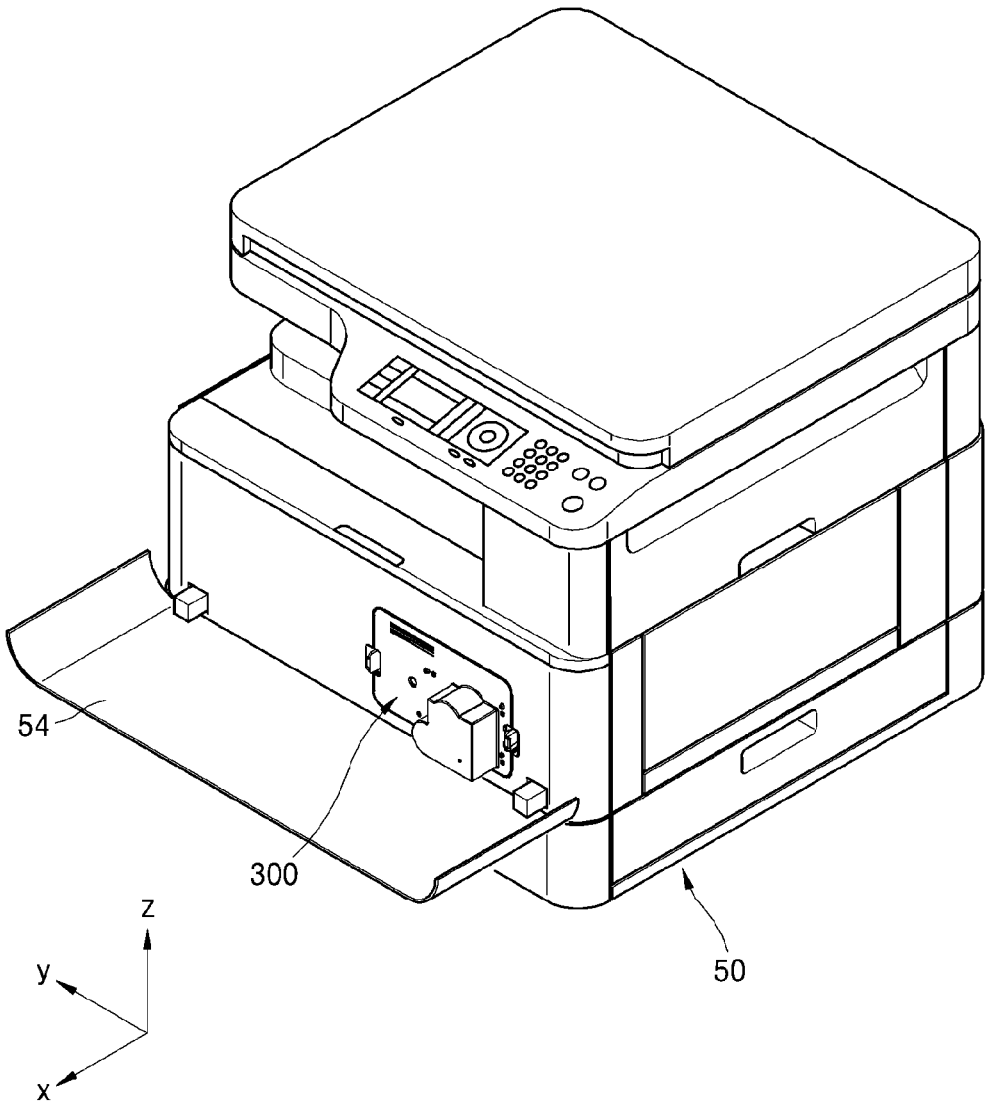
FIG. 3B illustrates an example in which the toner recycle unit is installed in the developing cartridge shown in FIG. 2.

FIG. 3A illustrates a state where the toner recycle unit 300 is removed from the developing cartridge 100. FIG. 3B illustrates a state where the toner recycle unit 300 is installed in the developing cartridge 100. Referring to FIGS. 3A and 3B, the developing cartridge 100 and the toner cartridge 200 are detachably installed in a main body 50 in a direction parallel to the longitudinal direction of the photosensitive drum 11. Although not shown in FIGS. 3A and 3B, the exposure 20, the transfer roller 30, the fixing unit 40, etc. which are described above, are installed in the main body 50.

An opening 51 is formed in the main body 50 so that the developing cartridge 100 and the toner cartridge 200 may be installed. The opening 51 is opened and closed by a cover 54. The developing cartridge 100 and the toner cartridge 200 may be individually installed in the main body 50 through the opening 51. The developing cartridge 100 and the toner cartridge 200 may be detachably installed in a direction (x direction) which is parallel to the longitudinal direction of the photosensitive drum 11.

The toner recycle unit 300 may be installed in the developing cartridge 100 through the opening 51 along an installation direction of the developing cartridge 100. For example, the toner recycle unit 300 may be installed in the rear end 100*a* in the installation direction of the developing cartridge 100. A user may open the cover 54 and immediately install the toner recycle unit 300 in the rear end 100*a* of the developing cartridge 100 or remove the toner recycle unit 300 from the developing cartridge 100. In other words, a user may replace only the toner recycle unit 300 without removing the developing cartridge 100. When the toner recycle unit 300 is not installed in the rear end 100*a* in the installation direction of the developing cartridge 100, for example when the toner recycle unit 300 is disposed above the developing cartridge 100, a user has to remove the developing cartridge 100 from the main body 50 in order to separate the toner recycle unit 300. In addition, when the toner recycle unit 300 is disposed above the developing cartridge 100, a separate vertical space for the toner recycle unit 300 is required to be provided within the main body 50. However, in the current embodiment, the toner recycle unit 300 is detachably installed in the developing cartridge 100 along the installation direction of the developing cartridge 100, and thus the toner recycle unit 300 may be easily separated without taking out the developing cartridge 100. In addition, the toner recycle unit 300 may be disposed without providing a separate vertical space.

Figure 4:
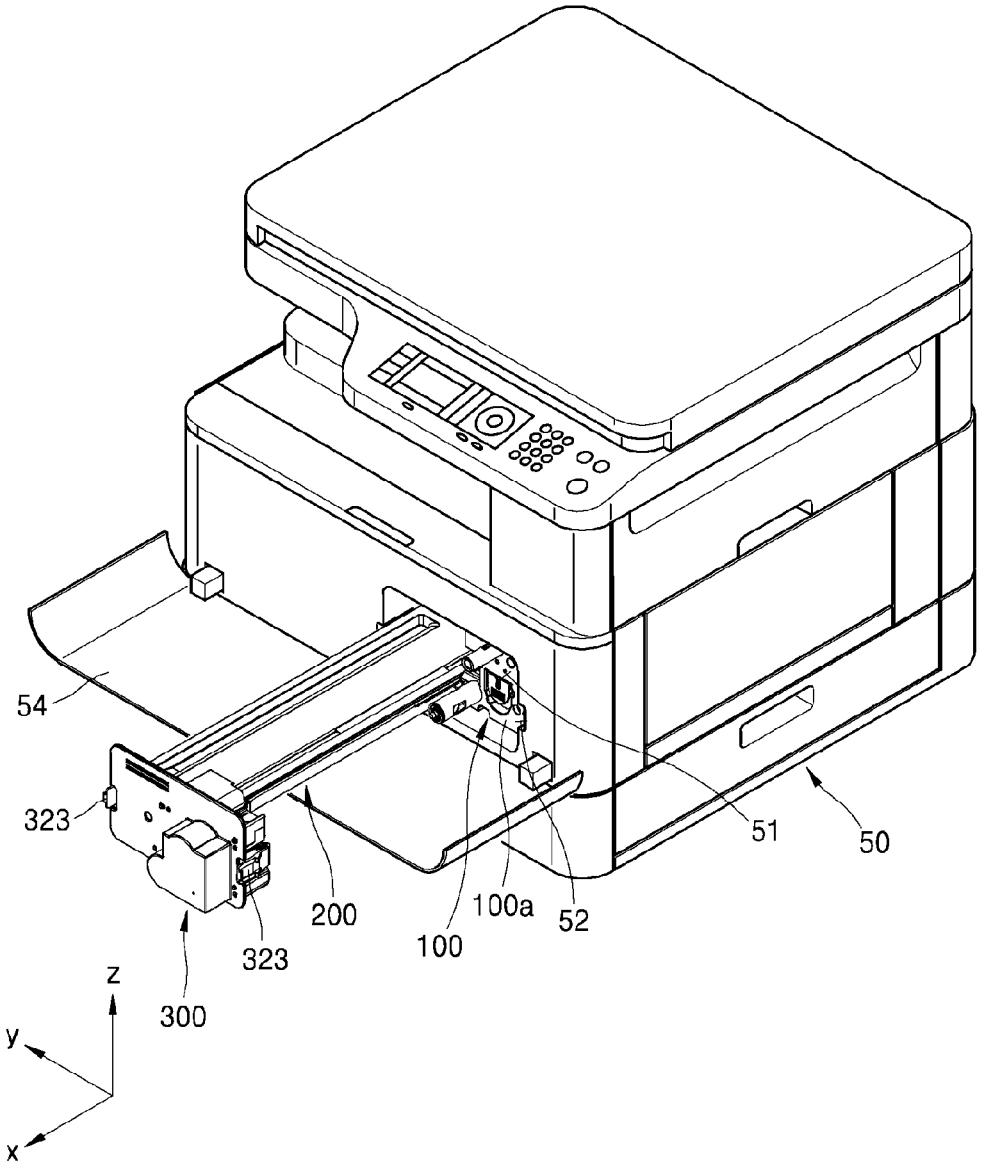
FIG. 4 illustrates another example in which the toner recycle unit is removed from the developing cartridge shown in FIG. 2.

As illustrated in FIG. 3A, the toner recycle unit 300 may be installed in the developing cartridge 100 separately from the toner cartridge 200, but is not limited thereto. For example, as illustrated in FIG. 4, the toner recycle unit 300 may be formed integrally with the toner cartridge 200, and thus the toner recycle unit 300 may be attached to or detached from the developing cartridge 100 together with the toner cartridge 200.

In the above-described embodiment, a description will be made with an emphasis on an example in which the installation direction of the developing cartridge 100 is a direction parallel to the longitudinal direction (x direction) of the photosensitive drum 11, but is not limited thereto. For example, the installation direction of the developing cartridge 100 may be a direction (y direction or z direction) which crosses the longitudinal direction (x direction) of the photosensitive drum 11.

Figure 5A:
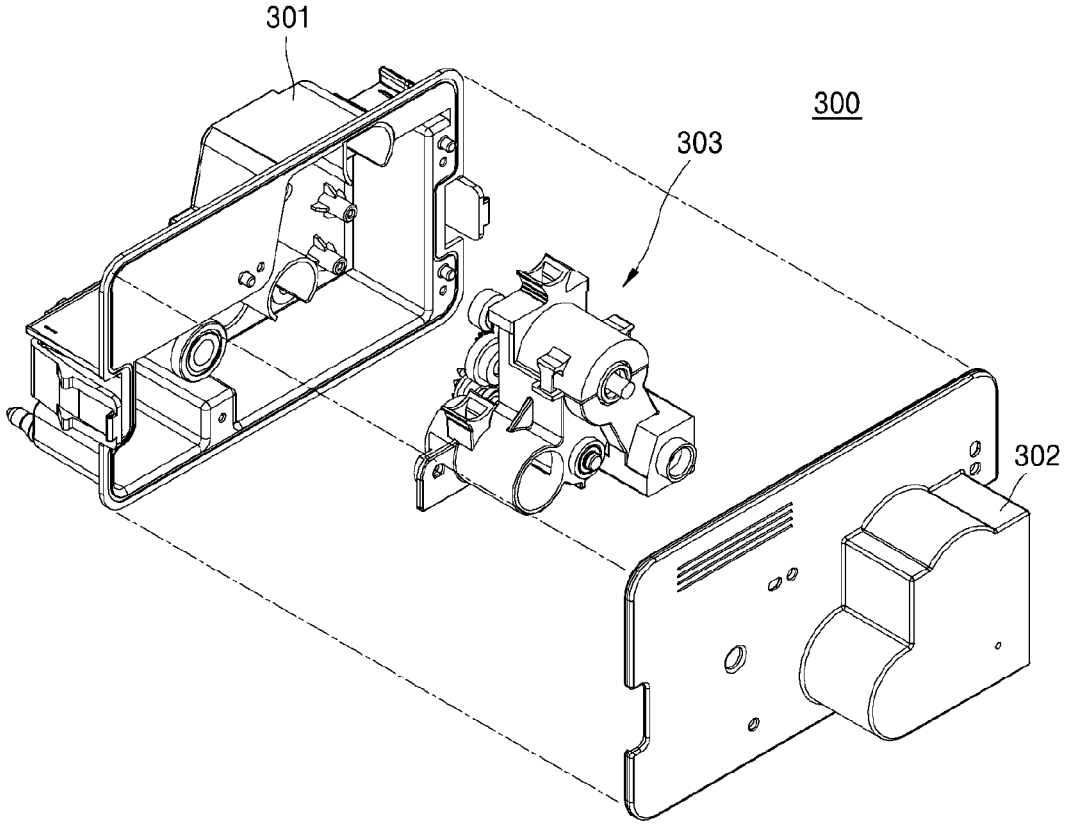
FIG. 5A is an exploded perspective view of a toner recycle unit of an image forming apparatus according to an embodiment.
Figure 5B:
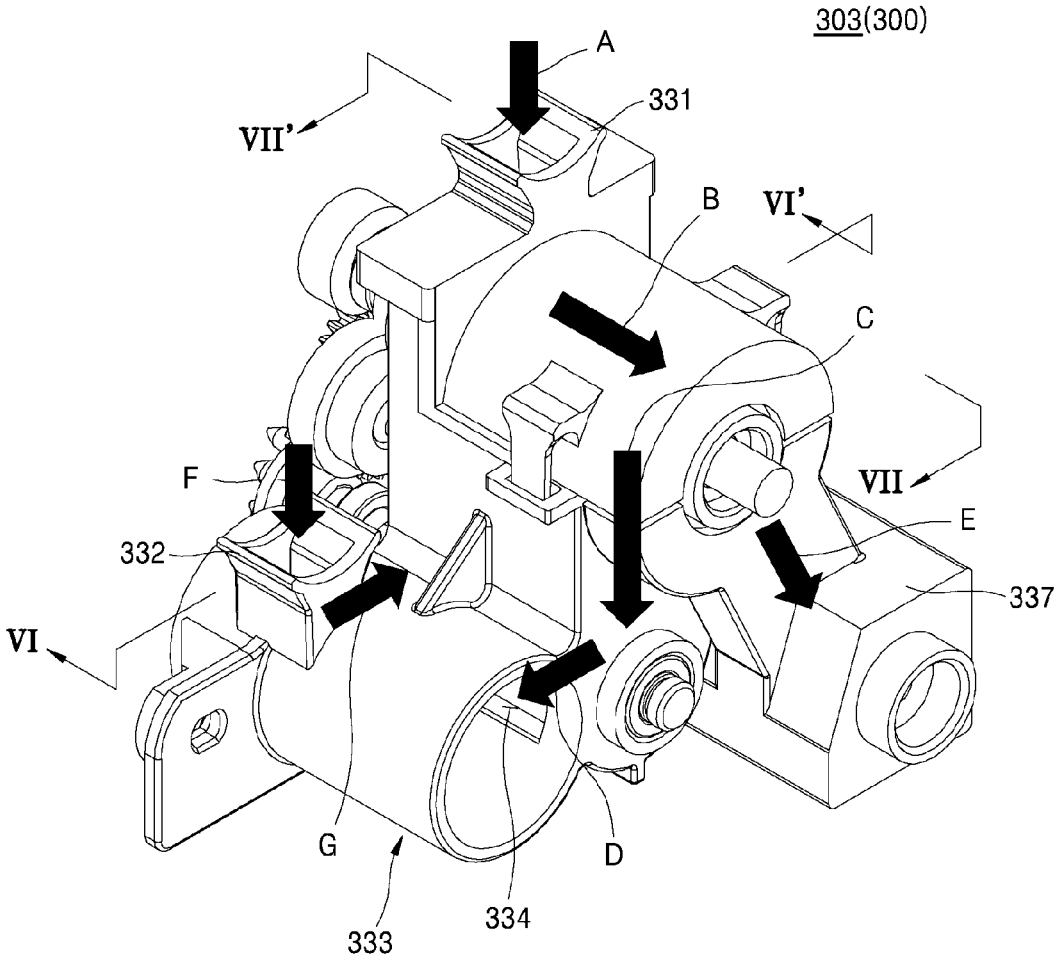
FIG. 5B is an enlarged perspective view of a toner processing unit of FIG. 5A.

FIG. 5A is an exploded perspective view of the toner recycle unit 300 of the image forming apparatus according to the current embodiment, and FIG. 5B is an enlarged perspective view of a toner processing unit (toner processor) 303 of FIG. 5A.

Referring to FIG. 5A, the toner recycle unit 300 includes a first cover 301, a second cover 302, and a toner processing unit 303. The first cover 301 and the second cover 302 form an appearance of the toner recycle unit 300. The toner processing unit 303 is disposed between the first cover 301 and the second cover 302. The first cover 301 is disposed to face the developing cartridge 100 and the toner cartridge 200.

Referring to FIG. 5B, the toner processing unit 303 recovers a toner from the developing cartridge 100 in the gravity direction, for example, an A direction, and is supplied with a fresh toner from the toner cartridge 200 in the gravity direction, for example, an F direction. The recovery toner recovered from the developing cartridge 100 is filtered during the process of moving in a direction crossing the gravity direction, for example, a B direction. A recycle toner satisfying an appropriate size in the recovery toner moves in the gravity direction, for example, a C direction, and a waste toner not satisfying the appropriate size moves in a direction crossing the B direction, for example, an E direction. The recycle toner moving in the C direction moves in a direction crossing the gravity direction, for example, a D direction to be supplied to the developing cartridge 100. The waste toner moving in the E direction is stored in a waste toner storage unit (toner storage) 337. The fresh toner supplied in the F direction moves in a G direction to be supplied to the developing cartridge 100.

Figure 6:
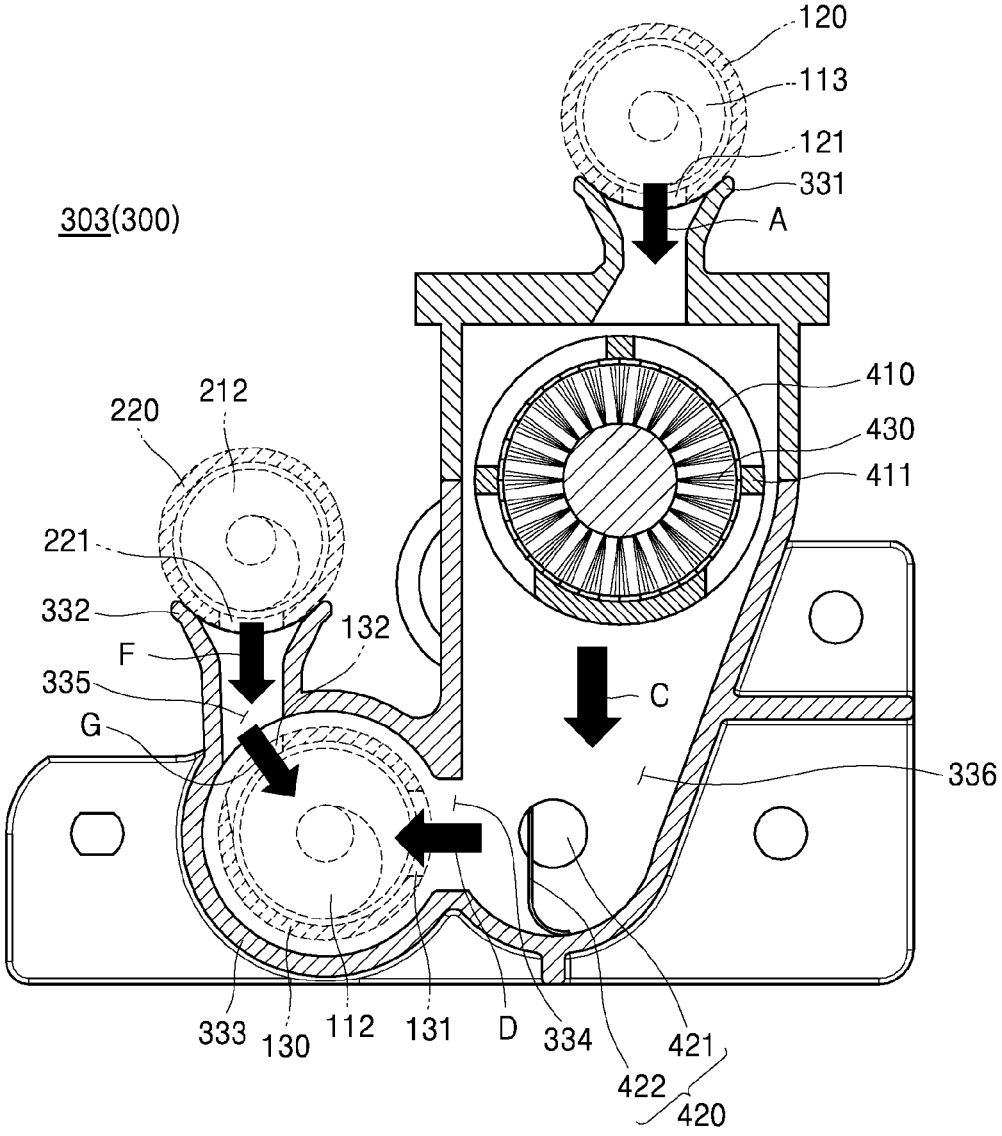
FIG. 6 is a cross-sectional view taken along line VI-VI' of the toner processing unit of FIG. 5B.
Figure 7:
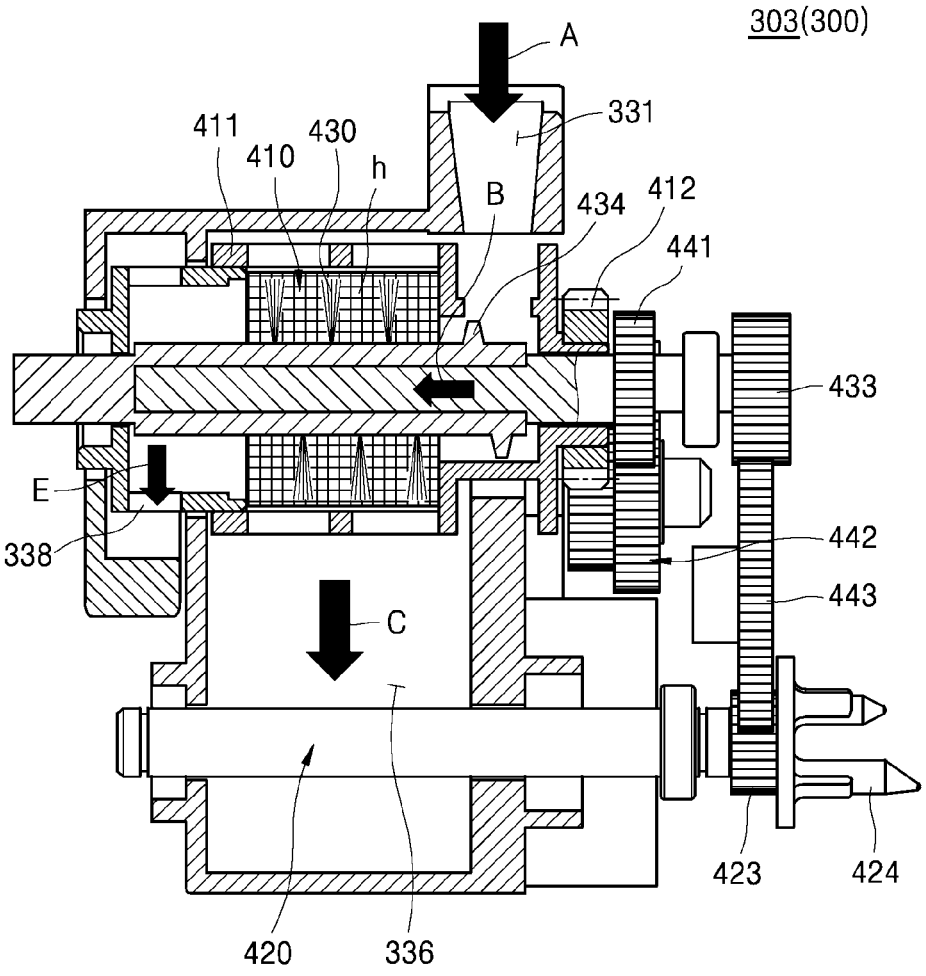
FIG. 7 is a cross-sectional view taken along line VII-VII' of the toner processing unit of FIG. 5B.

FIG. 6 is a cross-sectional view of the toner processing unit 303 taken along line VI-VI' of FIG. 5B, and FIG. 7 is a cross-sectional view of the toner processing unit 303 taken along line VII-VII' of FIG. 5B.

Referring to FIGS. 6 and 7, the toner processing unit 303 includes a recovery toner inlet 331 for recovering a toner from the developing cartridge 100, a fresh toner inlet 332 for receiving a toner from the toner cartridge 200, a filter member 410 that filters a recovery toner, and a mixed toner discharging unit 333 that discharges the recycle toner filtered by the filter member 410 and the fresh toner received from the toner cartridge 200. A recycle toner outlet 334 for discharging a recycle toner and a fresh toner outlet 335 for discharging a fresh toner are formed in the mixed toner discharging unit 333.

The toner recycle unit 300 is installed in the developing cartridge 100, and thus the first toner discharging unit 120 formed in an end of the developing cartridge 100 is connected to the recovery toner inlet 331 of the toner processing unit 303. A first outlet 121 may be formed in the first toner discharging unit 120 at the position corresponding to the recovery toner inlet 331. For example, the first outlet 121 may be formed in a lower portion of the first toner discharging unit 120. A toner discharged from the first outlet 121 formed on the lower side is recovered to the toner processing unit 303 by gravity in the A direction. The recovery toner recovered in the A direction starts to be transferred in the B direction by a transfer auger 434 formed on the upper stream of a filter cleaning member 430. The transfer auger 434 may be coaxially connected to the filter cleaning member 430. The recovery toner transferred in the B direction passes through the filter member 410. The filter member 410 may have a net structure, for example, a mesh structure. For example, the filter member 410 has a cylindrical shape as a whole, and micropores h having a size of approximately 80 um to 100 um may be formed in the filter member 410. A waste toner having a size larger than an appropriate size may be filtered through the micropores h formed in the filter member 410. In the process in which the recovery toner passes through the filter member 410 in the B direction, the recycle toner having a size equal to or less than a predetermined size passes through the micropores h and falls in the C direction by gravity. The waste toner that does not pass through the micropores h continuously moves in the B direction, and then falls in the E direction through an opening 338 formed in an end of supporting frame 411 and is stored in the waste toner storage unit 337.

The recycle toner falling in the C direction passes through a stirring chamber 336 and is discharged to the recycle toner outlet 334. A stirring member 420 that stirs and transfers the recycle toner is installed in the stirring chamber 336. The stirring member 420 may be configured in such a manner that a rotation axis 421 extends in the longitudinal direction of the photosensitive drum 11 and that one or a plurality of stirring blades 422 having a flexible film shape are provided in the rotation axis 421. The stirring member 420 stirs the recycle toner within the stirring chamber 336 and transfers the recycle toner in the D direction so as to be discharged to the recycle toner outlet 334. The recycle toner passing through the micropores h of the filter member 410 is stirred and transferred through the stirring member 420, and thus the recycle toner may be prevented from agglomeration (or cohering). The prevention of the agglomeration of the recycle toner may prevent the recycle toner from being accumulated within the stirring chamber 336 without being discharged to the recycle toner outlet 334. The stirring member 420 may be disposed so as to be adjacent and parallel to the recycle toner outlet 334.

In addition, the toner recycle unit 300 is installed in the toner cartridge 200, and thus the second toner discharging unit 220 of the toner cartridge 200 is connected to the fresh toner inlet 332 of the toner processing unit 303. A second outlet 221 may be formed in the second toner discharging unit 220 at the position corresponding to the fresh toner inlet 332. For example, the second outlet 221 may be formed in a lower portion of the second toner discharging unit 220. A fresh toner discharged by the second outlet 221 is supplied in the F direction through the fresh toner inlet 332. The fresh toner supplied in the F direction is discharged in the G direction through the fresh toner outlet 335 of the mixed toner discharging unit 333.

The toner recycle unit 300 is installed in the developing cartridge 100, and thus the toner injection unit 130 of the developing cartridge 100 is connected to the mixed toner discharging unit 333. The toner injection unit 130 is connected to the mixed toner discharging unit 333, and thus the recycle toner discharged through the recycle toner outlet 334 and the fresh toner discharged through the fresh toner outlet 335 are supplied to the toner injection unit 130. The recycle toner and the fresh toner which are supplied to the toner injection unit 130 are stirred by the second stirring member 112. Then, the recycle toner and the fresh toner are supplied to the developing roller 13 via the first stirring member 111, and thus an ordinary image forming process is performed.

The above-described recovery toner is likely to agglomerate as compared with a fresh toner, and thus the recovery toner may be easily attached to the micropores h of the filter member 410 in the process of passing through the filter member 410. For example, the recovery toner supplied to the toner recycle unit 300 may not pass through the micropores h of the filter member 410 and may be attached to an inner circumferential surface of the filter member 410. When this state is left as it is, the attached recovery toner is combined with other recovery toners, and thus the size thereof is gradually increased. As a result, the micropores h are blocked, which may obstruct a smooth filtering process. In order to remove the recovery toner attached to the inner circumferential surface of the filter member 410, the filter cleaning member 430 may be disposed within the filter member 410.

Figure 8:
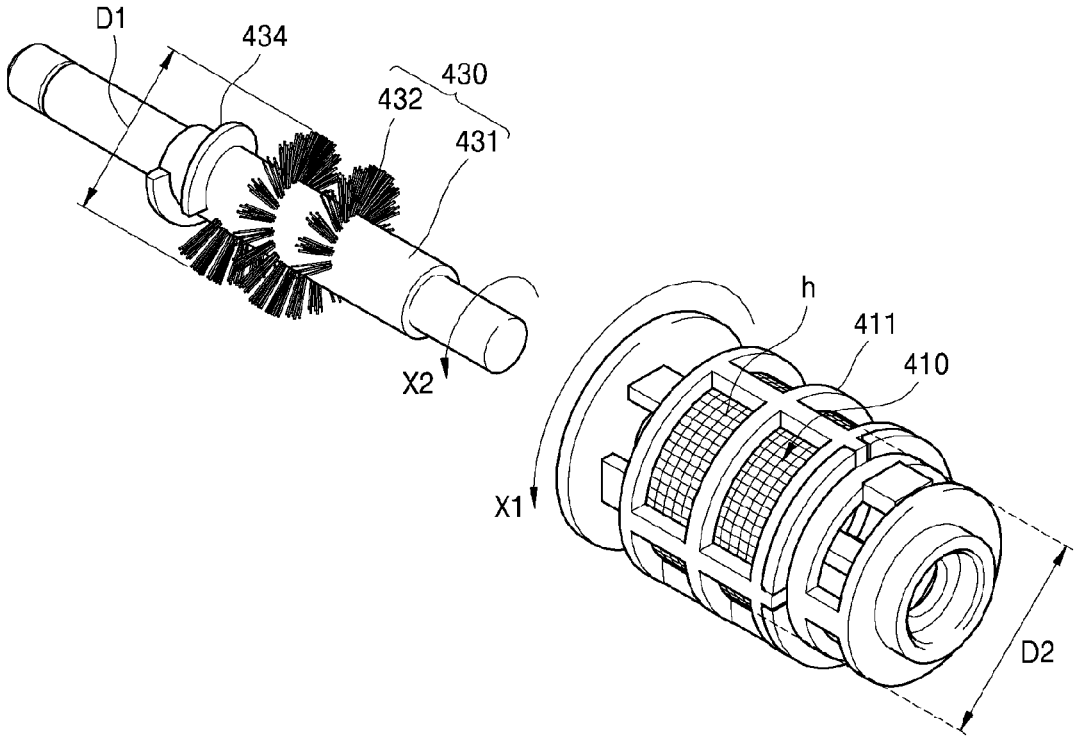
FIG. 8 is an exploded perspective view of a filter member and a filter cleaning member according to an embodiment.

FIG. 8 is an exploded perspective view of the filter member 410 and the filter cleaning member 430 according to the current embodiment. Referring to FIG. 8, the filter cleaning member 430 may rotate in a state where the filter cleaning member 430 comes into contact with the inner surface of the filter member 410. The filter member 410 is supported by a supporting frame 411. The filter cleaning member 430 may have a brush shape in which a rotation axis 431 and one or a plurality of blades 432 having a flexible film shape are provided. In order for the filter cleaning member 430 to come into contact with the inner surface of the filter member 410, a diameter D1 of the filter cleaning member 430 may be equal to or larger than an inner diameter D2 of the filter member 410. For example, a difference in size between the diameter D1 of the filter cleaning member 430 and the inner diameter D2 of the filter member 410 may be approximately 0 to 0.5 mm. The toner attached to the inner surface of the filter member 410 and the filter cleaning member 430 come into contact with each other in a friction manner by the rotation of the filter cleaning member 430, and the repetition of the friction contact separates the recovery toner attached to the inner circumferential surface of the filter member 410 therefrom.

The blade 432 of the filter cleaning member 430 may have a spiral shape. The filter cleaning member 430 having a spiral shape is rotated, and thus the recovery toner separated from the inner circumferential surface of the filter member 410 may be transferred in a predetermined direction. The transferred toner may be stored in the waste toner storage unit 337.

A portion of the recovery toner passing through the micropores h of the filter member 410 may dangle from or be attached to the outer circumferential surface of the filter member 410 by an agglomerative characteristic of the recovery toner. The recovery toner attached to the outer circumferential surface may also result in the blocking of the micropores h of the filter member 410. In order to prevent the toner from being attached to the outer circumferential surface of the filter member 410, the filter member 410 may be rotated. A rotational speed X1 of the filter member 410 may be different from a rotational speed X2 of the filter cleaning member 430. For example, the rotational speed X1 of the filter member 410 may be lower than the rotational speed X2 of the filter cleaning member 430. The rotational speeds X1 and X2 of the filter member 410 and the filter cleaning member 430 are differently set, and thus the recovery toner may be prevented from being attached to the outer circumferential surface of the filter member 410, and the recovery toner attached to the inner circumferential surface of the filter member 410 may be removed by the filter cleaning member 430.

As described above, the toner recycle unit 300 may rotationally drive the filter member 410 and the filter cleaning member 430 in order to prevent the recovery toner from being attached to the filter member 410, and may rotationally drive the stirring member 420 in order to prevent the recycle toner passing through the filter member 410 from cohering.

The toner recycle unit 300 according to the current embodiment receives a driving force from the developing cartridge 100 without providing a separate driving unit, which allows the above-described rotational driving operations to be realized. Thus, manufacturing costs may be reduced without increasing the size of the apparatus.

Figure 9:
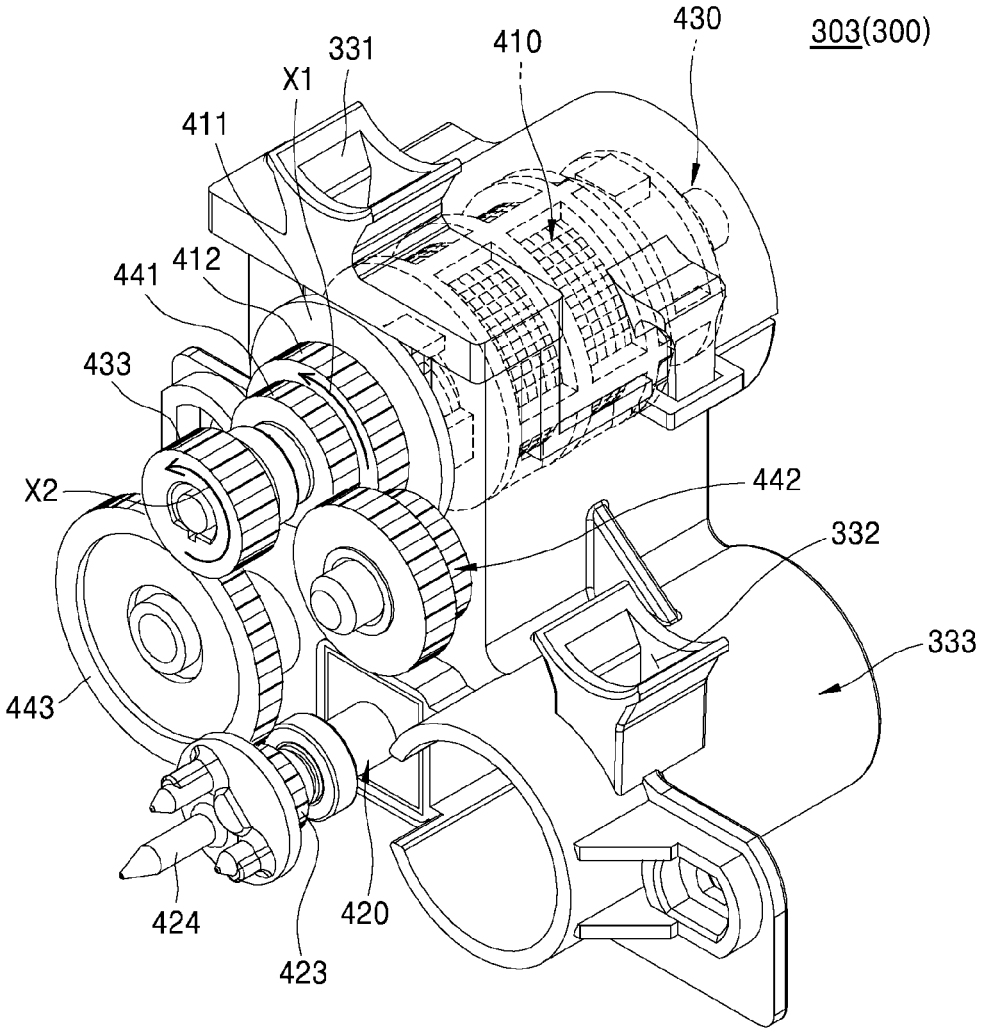
FIG. 9 is a schematic diagram mainly illustrating a driving system of a toner recycle unit.
Figure 10:
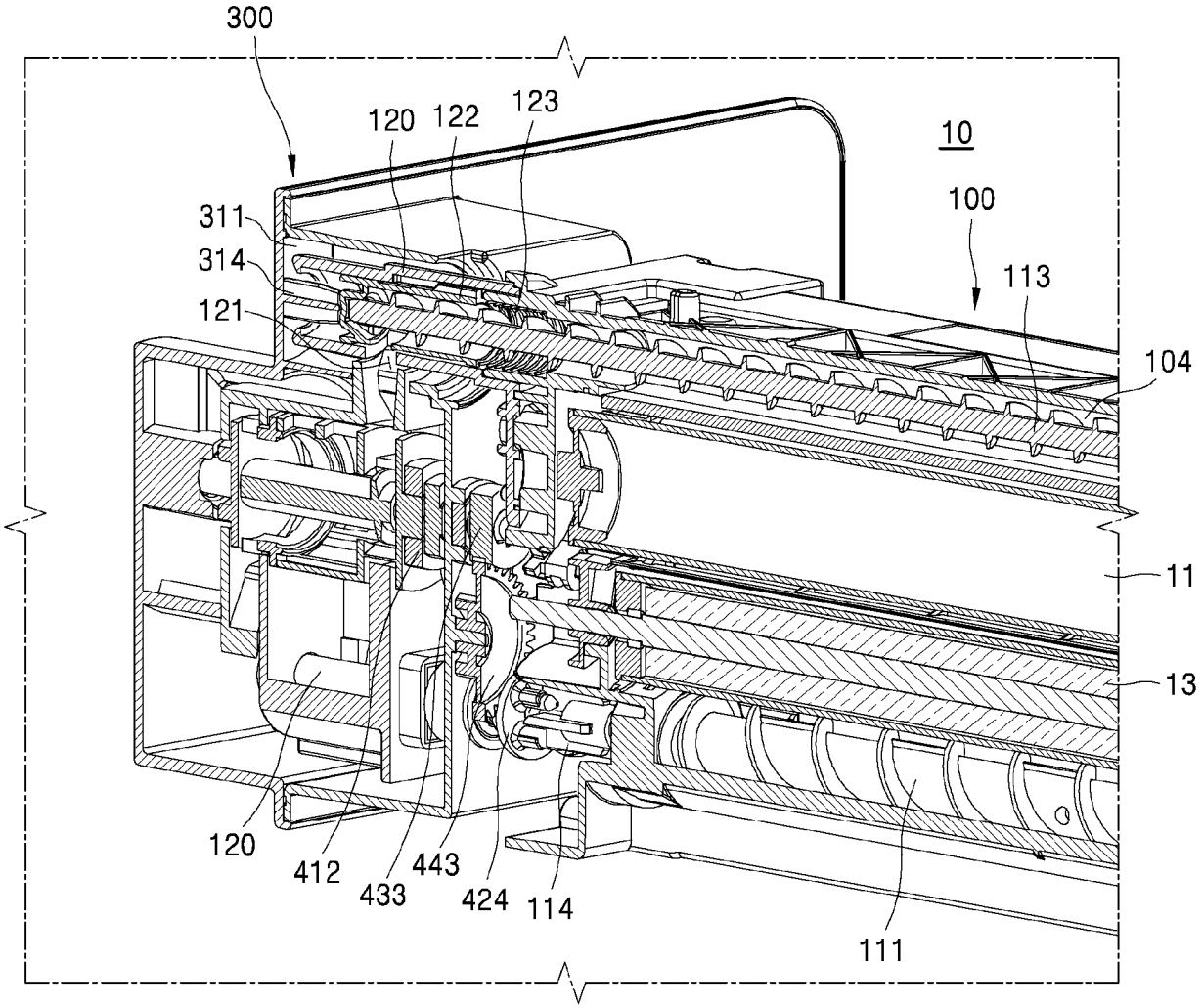
FIG. 10 is a cross-sectional view of a toner recycle unit which is coupled to a developing cartridge.

FIG. 9 is a schematic diagram mainly illustrating a driving system of the toner recycle unit 300. FIG. 10 is a cross-sectional view of the toner recycle unit 300 which is coupled to a developing cartridge.

Referring to FIG. 9, the toner recycle unit 300 includes a first driving gear 423 that rotates the stirring member 420, a second driving gear 433 that rotates the filter cleaning member 430, and a third driving gear 412 that rotates the filter member 410.

Referring to FIGS. 9 and 10, a coupler 424 may be installed in the first driving gear 423. The first driving gear 423 may be coaxially connected to the first stirring member 111 of the developing cartridge 100 through the coupler 424 to receive a driving force. When the toner recycle unit 300 is installed in the developing cartridge 100, the coupler 424 installed in the first driving gear 423 may be coupled to the coupler 114 installed in the end of the first stirring member 111 of the developing cartridge 100. Thus, the first driving gear 423 receives a driving force from the first stirring member 111. In addition, when the first stirring member 111 and the second stirring member 112 of the developing cartridge 100 are disposed so as to be adjacent and parallel to each other, the first driving gear 423 connected to the first stirring member 111 of the developing cartridge 100 may be disposed so as to be adjacent and parallel to the toner injection unit 130 formed in the second stirring chamber 103. Thus, the stirring member 420 of the toner recycle unit 300 may be disposed so as to be adjacent and parallel to the recycle toner outlet 334 without a complex connection structure between the first driving gear 423 and the stirring member 420.

Referring to FIG. 9, the second driving gear 433 may be associated with (coupled to) the first driving gear 423 through a first idle gear 443. The second driving gear 433 may be associated with the first driving gear 423 connected to the second stirring member 112 of the developing cartridge 100 to rotate the second driving gear 433 without a separate driving unit. The recovery toner attached to the inner circumferential surface of the filter member 410 may be removed by the filter cleaning member 430 being rotated by the second driving gear 433.

The third driving gear 412 may be associated with (coupled to) the second driving gear 433 through the first reduction gear 441 and the second reduction gear 442. By the third driving gear 412 being associated with the second driving gear 433, the third driving gear 412 may be rotated without installing a separate driving unit for rotating the third driving gear 412. Rotational speeds X2 and X1 and of the second driving gear 433 and the third driving gear 412 may be differently set through the first and second reduction gears 441 and 442. For example, the rotational speed X2 of the second driving gear 433 may be approximately 1.2 to 1.5 times the rotational speed X1 of the third driving gear 412. The rotational speed X2 of the third driving gear 412 may be adjusted according to a ratio between the first reduction gear 441 and the second reduction gear 442. The supporting frame 411 may be rotated in association with the rotation of the third driving gear 412, and the filter member 410 supported by the supporting frame 411 may be rotated.

In the above-described embodiment, a description will be made with an emphasis on an example in which the first driving gear 423 is connected to the first stirring member 111 of the developing cartridge 100. However, insofar as it is configured such that the toner recycle unit 300 receives a driving force from the developing cartridge 100, an object to be connected to the first driving gear 423 may vary.

As described above, any one of the first, second, and third driving gears 423, 433, and 412 is connected to the developing cartridge 100, and the driving gears 433 and 412 are associated with (coupled to) the driving gear 423 connected to the developing cartridge 100, and thus a separate driving unit for driving the toner recycle unit 300 may not be installed, thereby preventing the toner recycle unit 300 from being increased in size and reducing manufacturing costs.

Figure 11:
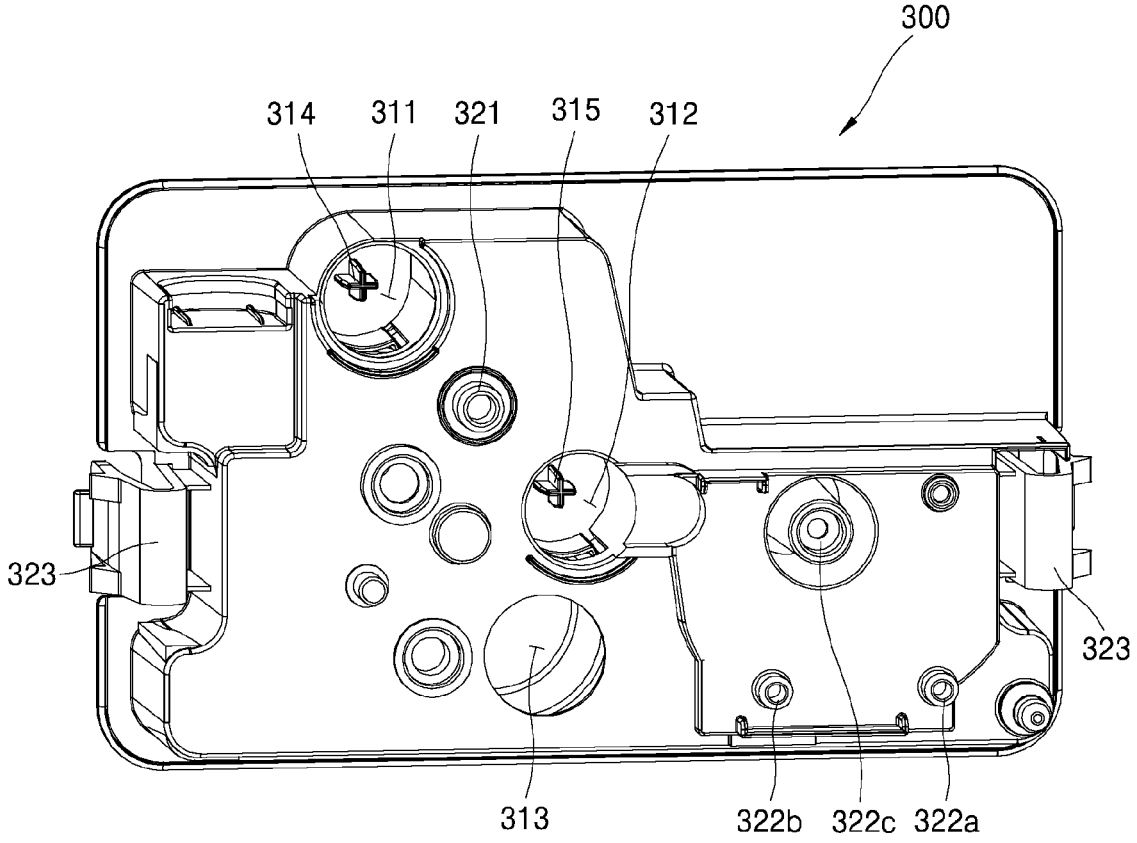
FIG. 11 is an assembled perspective view of a toner recycle unit.

FIG. 11 is a perspective view of the toner recycle unit 300. Referring to FIG. 11, the toner recycle unit 300 may include a first insertion hole 311, a second insertion hole 312, and a third insertion hole 313. The first toner discharging unit 120 of the developing cartridge 100 may be inserted into the first insertion hole 311, and the second toner discharging unit 220 may be inserted into the second insertion hole 312. The toner injection unit 130 of the developing cartridge 100 may be inserted into the third insertion hole 313. The first toner discharging unit 120 inserted into the first insertion hole 311 is connected to the recovery toner inlet 331 of the toner processing unit 303. The second toner discharging unit 220 inserted into the second insertion hole 312 is connected to the fresh toner inlet 332 of the toner processing unit 303. The toner injection unit 130 inserted into the third insertion hole 313 is connected to the recycle toner outlet 334 and the fresh toner outlet 335 of the toner processing unit 303.

A first boss 314 protruding toward the first toner discharging unit 120 may be formed in the first insertion hole 311. Referring to FIG. 10, when the toner recycle unit 300 is installed in the developing cartridge 100, the first boss 314 presses the first shutter 122 disposed at the end of the first toner discharging unit 120. Thus, the first shutter 122 moves in the installation direction of the toner recycle unit 300, and the first outlet 121 of a first toner outlet is opened. When the toner recycle unit 300 is removed from the developing cartridge 100, the first boss 314 moves in the opposite direction to the installation direction, and a pressing force acting on the first shutter 122 is released. Thus, the first shutter 122 returns to the original position by an elastic member 123, and the first outlet 121 of the first toner discharging unit 120 is closed.

A second boss 315 protruding toward the second toner discharging unit 220 may be formed in the second insertion hole 312. An operation relationship between the second boss 315 and the second shutter 222 may adopt the above-described operation relationship between the first boss 314 and the first shutter 122.

The toner recycle unit 300 includes a first coupling unit (first coupler) 321 to be coupled to the developing cartridge 100, and second coupling units (second couplers) 322*a*, 322*b*, and 322*c* to be coupled to the toner cartridge 200. The first coupling unit 321 of the toner recycle unit 300 has a shape corresponding to the first coupling unit 141 formed in the developing cartridge 100, and may be coupled to the first coupling unit 141 of the developing cartridge 100 when the toner recycle unit 300 is installed in the developing cartridge 100. For example, the first coupling unit 321 of the toner recycle unit 300 has a projection shape, and the first coupling unit 141 of the developing cartridge 100 may have a groove shape corresponding to the projection. The second coupling units 322*a*, 322*b*, and 322*c* of the toner recycle unit 300 have shapes corresponding to second coupling units 231*a*, 231*b*, and 231*c* formed in the toner cartridge 200, and may be coupled to the second coupling units 231*a*, 231*b*, and 231*c* of the toner cartridge 200 when the toner recycle unit 300 is installed in the toner cartridge 200. For example, the second coupling units 322*a*, 322*b*, and 322*c* of the toner recycle unit 300 have the plurality of projections 322*a* and 322*b* and the groove 322*c*, and the second coupling units 231*a*, 231*b*, and 231*c* of the toner cartridge 200 may have the plurality of grooves 231*a* and 231*b* and the projection 231*c* which correspond to the projections 322*a* and 322*b* and the groove 322*c*. An installation order of the toner recycle unit 300 with respect to the toner cartridge 200 and the developing cartridge 100 may be adjusted through the design of the first coupling unit 321 and the second coupling units 322*a*, 322*b*, and 322*c*. For example, the height of the projections and the groove of the first coupling unit 321 and the second coupling units 322*a*, 322*b*, and 322*c* are adjusted, and thus the toner recycle unit 300 may be set to be installed in the toner cartridge 200 and then installed in the developing cartridge 100.

In addition, the toner recycle unit 300 may include a third coupling unit (third coupler) 323 to be coupled to the main body 50. The toner recycle unit 300 may be coupled to the main body 50 through the third coupling unit 323 to stably support ends of the toner cartridge 200 and the developing cartridge 100. Thus, the vibration of the toner cartridge 200 and the developing cartridge 100 may be reduced. The third coupling unit 323 may be coupled to a coupling groove 52 (see FIG. 3A) which is formed in the opening 51 of the main body 50. For example, the third coupling unit 323 may have a hook shape. However, the shape of the third coupling unit 323 is not limited thereto, and may vary when necessary.

Figure 12:
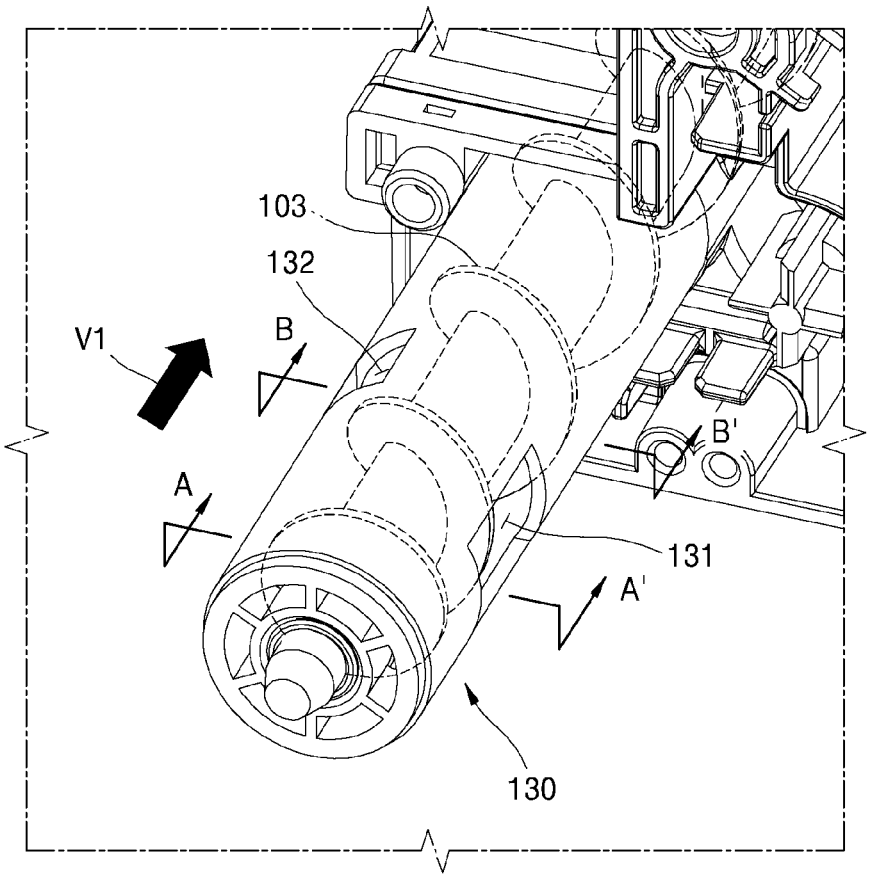
FIG. 12 is an enlarged view of a toner injection unit of a developing cartridge.

FIG. 12 is an enlarged view of the toner injection unit 130 of the developing cartridge 100. The toner injection unit 130 of the developing cartridge 100 has a shape extending along the longitudinal direction of the second stirring member 112, and may protrude toward the toner recycle unit 300. The toner injection unit 130 may be provided with a first inlet 131 for injecting a recycle toner and a second inlet 132 for injecting a fresh toner. By the insertion of the toner injection unit 130 into the third insertion hole 313 of the toner recycle unit 300, the first inlet 131 and the second inlet 132 are connected to the recycle toner outlet 334 and the fresh toner outlet 335 of the toner recycle unit 300 as illustrated in FIG. 6. Thus, a recycle toner filtered by the filter member 410 is injected into the first inlet 131, and a fresh toner supplied from the toner cartridge 200 is injected into the second inlet 132.

Referring to FIG. 12, the first inlet 131 may be disposed on the upper steam side than the second inlet 132 in a toner transfer direction V1 by the second stirring member 112. By the first inlet 131 being disposed upstream from the second inlet 132 in the toner transfer direction V1, a recycle toner may be injected first, and then a fresh toner may be injected. The size of the recycle toner is larger than the size of the fresh toner, and thus the recycle toner having a relatively large size may be injected prior to the fresh toner, and thus a stirring performance for the recycle toner and the fresh toner may be improved.

Figure 13A:
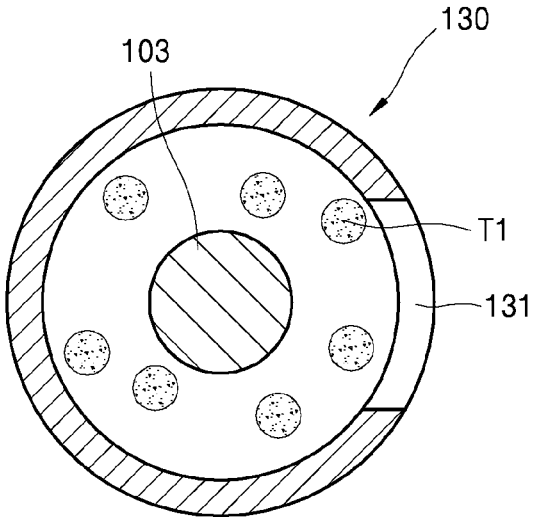
FIG. 13A is a cross-sectional view taken along line A-A' of FIG. 12.
Figure 13B:
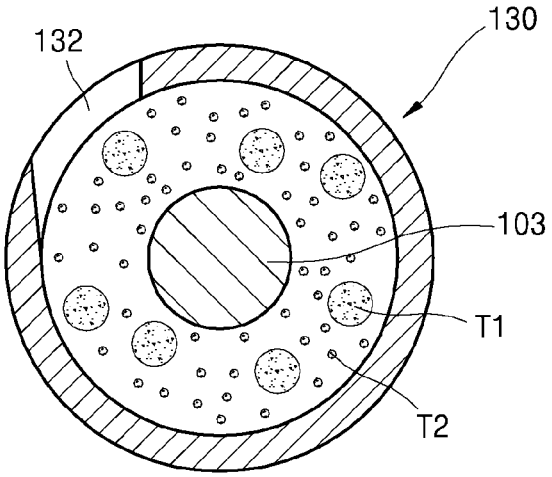
FIG. 13B is a cross-sectional view taken along line B-B' of FIG. 12, and FIGS. 13A and 13B conceptually illustrate a state where a recycle toner and a fresh toner.
Figure 14:
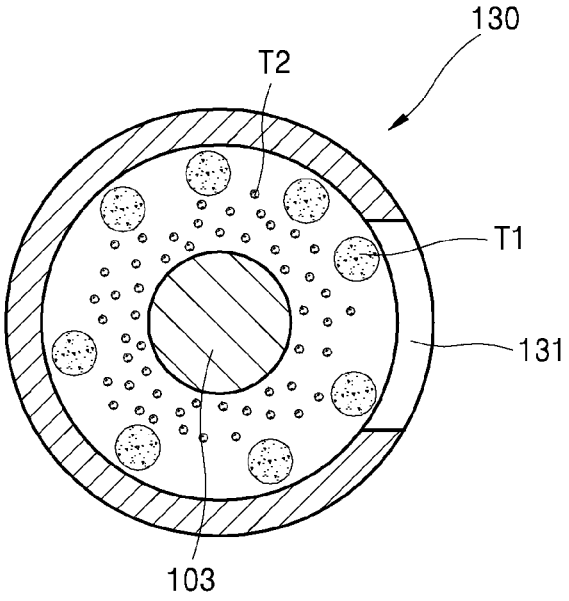
FIG. 14 is a conceptual diagram illustrating a stirring state of a recycle toner and a fresh toner according to a comparative example.

FIG. 13A is a cross-sectional view taken along line A-A' of FIG. 12, FIG. 13B is a cross-sectional view taken along line B-B' of FIG. 12, and FIGS. 13A and 13B conceptually illustrate a stirring state of a toner. As illustrated in FIG. 13A, a recycle toner T1 having a relatively large size is first injected through the first inlet 131 disposed on the upper stream side. Thereafter, as illustrated in FIG. 11B, a fresh toner T2 having a relatively small size is injected through the second inlet 132. In this manner, the recycle toner T1 having a relatively large size is first injected, and then the fresh toner T2 having a relatively small size is injected, and thus the fresh toner T2 may be inserted between the recycle toners T1, thereby allowing the recycle toner T1 and the fresh toner T2 having different sizes to be uniformly mixed with each other. On the other hand, when the fresh toner T2 having a relatively small size is injected prior to the recycle toner T1, the recycle toner T1 having a relatively large size is injected in a state where the fresh toner T2 having a relatively small size is injected and thus the recycle toner T1 may not be inserted between the fresh toners T2. Thus, as illustrated in FIG. 14, the fresh toner T2 and the recycle toner T1 may not be uniformly mixed with each other, which leads to degradation in image quality. However, in the current embodiment, a supplying order of the recycle toner T1 and the fresh toner T2 is adjusted, thereby the recycle toner T1 and the fresh toner T2 to be smoothly stirred.

In an above-described embodiment, a process cartridge in which a photosensitive unit including the photosensitive drum 11 and a developing unit including the developing roller 13 are integrally formed has been described as an example of the developing cartridge 100, but the scope of an embodiment is not limited to this. For example, the developing cartridge 100 according to an embodiment may be applied to a structure in which a photosensitive unit and a developing unit may be separated from each other.

According to the above-described developing device and electrophotographic image forming apparatus, an attachment and detachment property of the toner recycle unit is improved, and thus the replacement or maintenance of the toner recycle unit can be simplified.

In addition, according to the above-described developing device and electrophotographic image forming apparatus, the toner recycle unit is driven without installing a separate driving unit, and thus the size and costs can be reduced.

It should be understood that the exemplary embodiments described therein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the present disclosure as defined by the following claims.

What is claimed is:

1. An electrophotographic image forming apparatus comprising:

a main body having an opening;

a developing cartridge, detachably installed in the main body through the opening in a first direction, which comprises a photosensitive drum and a cleaning member for removing a toner remaining in the photosensitive drum; and a toner recycle unit, detachably installed in the developing cartridge through the opening in the first direction, which recovers the toner removed by the cleaning member, filters the recovered toner, and supplies the filtered recovered toner to the developing cartridge.

2. The electrophotographic image forming apparatus of claim 1, wherein the toner recycle unit comprises a filter member that filters the recovered toner.

3. The electrophotographic image forming apparatus of claim 2, wherein:

the developing cartridge further comprises a transport chamber in which a transport member, which transfers the toner removed by the cleaning member in the first direction, is installed, and a first toner discharging unit, which discharges the toner transferred by the transport member to the toner recycle unit, is formed in an end of the transport chamber in the first direction.

4. The electrophotographic image forming apparatus of claim 2, further comprising a toner cartridge, detachably installed in the main body through the opening in the first direction, which supplies toner accommodated therein to the toner recycle unit.

5. The electrophotographic image forming apparatus of claim 4, wherein:

the toner cartridge further comprises a transport chamber in which a transport member, which transfers toner accommodated therein in the first direction, is installed, and a second toner discharging unit, which discharges the toner transferred by the transport member to the toner recycle unit, is formed in an end of the transport chamber in the first direction.

6. The electrophotographic image forming apparatus of claim 5, wherein the developing cartridge comprises:

a developing chamber in which a developing roller, disposed to face the photosensitive drum, is installed;

a first stirring chamber in which a first stirring member, disposed to face the developing roller, stirring toner, and transferring toner, is installed; and a second stirring chamber in which a second stirring member, stirring and transferring toner so as to supply the toner to the first stirring member, is installed.

7. The electrophotographic image forming apparatus of claim 6, wherein a toner injection unit, having a toner injected thereinto, is formed in an end of the second stirring chamber in the first direction.

8. The electrophotographic image forming apparatus of claim 7, wherein:

the toner injection unit is provided with a first inlet into which toner, filtered by the filter member, is injected, and the toner injection unit is provided with a second inlet into which toner, supplied from the toner cartridge, is injected, and the first inlet is disposed upstream from the second inlet in a toner transfer direction.

9. The electrophotographic image forming apparatus of claim 6, wherein the toner recycle unit further comprises a stirring member that stirs and transfers toner filtered by the filter member.

10. The electrophotographic image forming apparatus of claim 9, wherein the toner recycle unit further comprises a filter cleaning member which is rotatable in a contact state with an inner surface of the filter member.

11. The electrophotographic image forming apparatus of claim 10, wherein the filter member is rotatable, and the filter member and the filter cleaning member have different rotational speeds.

12. The electrophotographic image forming apparatus of claim 11, wherein the filter member and the filter cleaning member are connected to each other by at least one reduction gear.

13. The electrophotographic image forming apparatus of claim 11, wherein the stirring member of the toner recycle unit receives a driving force from the first stirring member of the developing cartridge.

14. The electrophotographic image forming apparatus of claim 13, wherein at least one of the filter member and the filter cleaning member is coupled to the stirring member.

15. The electrophotographic image forming apparatus of claim 1, wherein the toner recycle unit receives a driving force from the developing cartridge.

16. The electrophotographic image forming apparatus of claim 1, wherein the first direction is parallel to a longitudinal direction of the photosensitive drum.

17. A developing device comprising:

a developing cartridge comprising a photosensitive drum, and a cleaning member that removes a residual toner which is not transferred to the photosensitive drum; and a toner recycle unit, detachably installed in the developing cartridge in parallel with a longitudinal direction of the photosensitive drum, which recovers the toner removed by the cleaning member, filters the recovered toner, and supplies the filtered recovered toner to the developing cartridge.

18. The developing device of claim 17, wherein the toner recycle unit receives a driving force from the developing cartridge.

* * * * *